United States Patent [19]

Bonner

[11] 4,138,156

[45] Feb. 6, 1979

[54] WEARABLE CHAIR

[76] Inventor: Darcy R. Bonner, 4700 Royal La., Dallas, Tex. 75229

[21] Appl. No.: 830,469

[22] Filed: Sep. 6, 1977

[51] Int. Cl.[2] ..... A47C 1/00

[52] U.S. Cl. ..... 297/4; 297/DIG. 10

[58] Field of Search ..... 297/4, DIG. 10

[56] References Cited

U.S. PATENT DOCUMENTS

| | | | |
|---|---|---|---|
| 671,638 | 4/1901 | Slagle | 297/4 |
| 768,478 | 8/1904 | Nash | 297/4 |
| 2,631,652 | 3/1953 | Bannister | 297/4 |
| 3,158,398 | 11/1964 | Stryker | 297/DIG. 10 |

FOREIGN PATENT DOCUMENTS

| | | | |
|---|---|---|---|
| 1066000 | 9/1959 | Fed. Rep. of Germany | 297/4 |
| 374569 | 6/1932 | United Kingdom | 297/4 |

*Primary Examiner*—Francis K. Zugel

*Attorney, Agent, or Firm*—Richards, Harris & Medlock

[57] ABSTRACT

An apparatus for supporting the weight of an individual's body includes a unit for attachment to each leg. Each unit includes a lower bar having an upper section and lower section which is longitudinally extendable from the upper section. The upper section is fitted with straps to permit attachment of the lower bar to the lower leg of the individual. An upper bar is hingeably connected to the upper end of the lower bar and a brace member, pivotable from the upper bar, is selectively positionable between the upper bar and the lower section of the lower bar. As the individual crouches into a rest position, the upper leg of the individual engages the upper bar and by engaging the brace into the lower section of the lower bar extends the lower section of the lower bar to support the unit, and the weight of the individual, from the ground.

22 Claims, 11 Drawing Figures

WEARABLE CHAIR

FIELD OF THE INVENTION

This invention relates to an apparatus for supporting the weight of an individual's body, and more particularly to such a structure which may be worn by attachment to the legs of the individual.

BACKGROUND OF THE INVENTION

Prior Art

Numerous occupations and recreational activities require long periods of standing or use of the legs but do not readily permit the use of seating structure on which an individual can rest. For example, assembly line workers who must have freedom of movement from one workstation to the other normally have no ready access to a chair or other seating support during intermittent idle periods between work projects. Also, where seating is provided, it is usually not readily accessible to the worker but rather is located out of the immediate work area.

The same absence of any seating exists in numerous sporting events where the spectator or even the participant must move from one location to the other. For example, while observing a golf tournament or other similar event, a seating structure would be desirable but has not heretofore been practical. Also, hikers and campers having generally done without the luxury of seating simply because of the added inconvenience or the inability of carrying a chair in addition to other equipment.

Thus, a need has arisen for a simple and lightweight body support which is readily accessible to the user but which does not necessarily have to be hand carried.

SUMMARY OF THE INVENTION

The present invention provides an apparatus for supporting the weight of an individual's body and includes a support unit for attachment to each of the individual's legs. In the preferred embodiment each unit includes a lower bar with appropriate straps for attachment to the lower leg of the individual. An upper bar is hingeably connected to the lower bar and a brace member, pivotally connected from the upper bar, is selectively positionable between the upper bar and the lower bar to form a triangular support structure. The lower bar includes an upper section and a lower section which is longitudinally extendable from the upper section. Springs are attached between the lower and upper sections of the lower bar and normally urge the lower section upwardly into the upper section. The lower section has a plurality of apertures therein for receiving the end of the brace member opposite its pivotal connection to the upper bar.

As the user crouches into a seating position, the upper portion of the upper bar is engaged by the upper leg of the user and pivoted downwardly. Correspondingly, the brace member is engaged into the apertures in the lower section of the lower bar to extend the lower section until it engages the ground. In this way, a triangular support is achieved with the user's body being supported primarily by the unit.

In accordance with one embodiment of the invention, each unit has a first U-shaped structure attached to the upper section of the lower bar contoured to receive the calf of the user's leg. Two straps are attached from this U-shaped structure and are selectively engagable around the lower leg of the user to attach the unit to the legs.

A second U-shaped support is attached to the upper end of the upper bar and is contoured to engage the thigh area of the user. Springs are connected between the upper and lower bars which normally urge the upper bar and the thigh support against the back portion of the user's thigh at all times. The lower section of the lower bar is also fitted with a pivotal foot member for engagement against the ground during use of the support.

In accordance with another embodiment of the invention, both the upper and lower bars may be lengthened or shortened so that the units may be fitted to the particular height of the user.

BRIEF DESCRIPTION OF THE DRAWINGS

For a complete understanding of the present invention, and for further details and advantages thereof, reference is now made to the following description taken in conjunction with the accompanying drawings, in which.

DESCRIPTION OF THE PREFERRED EMBODIMENT

Figure 1:
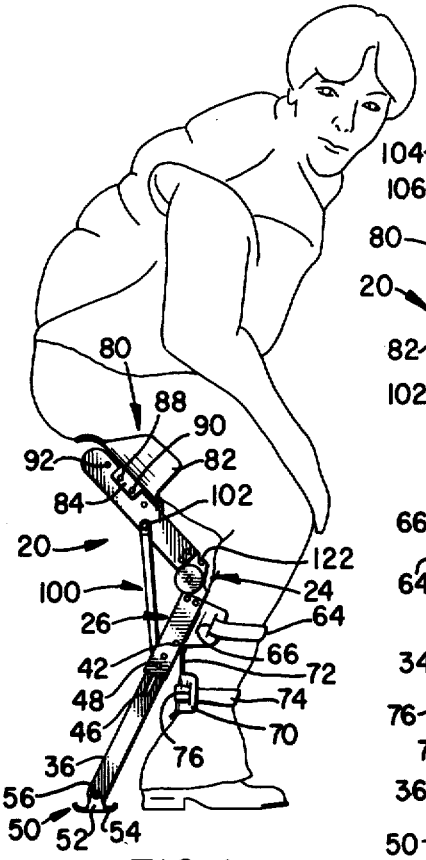
FIG. 1 illustrates a side view of the support unit of the present invention worn by an individual with the unit in the seated position.
Figure 2:
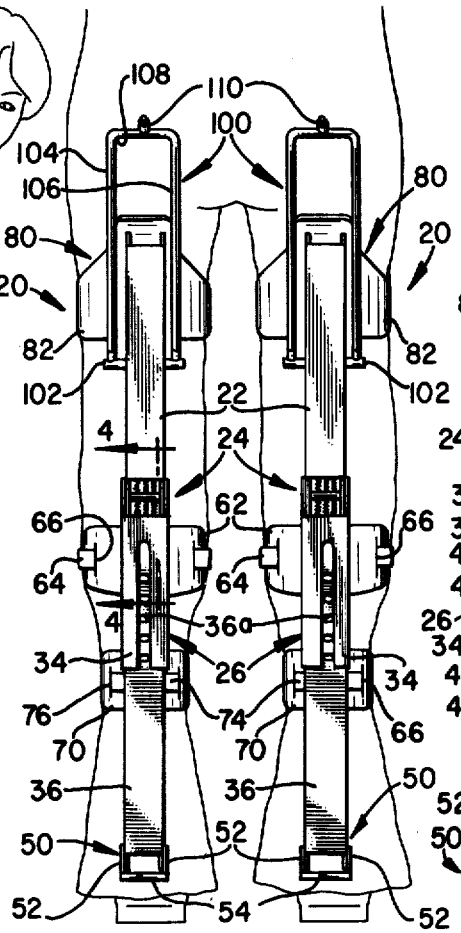
FIG. 2 illustrates a rear view of the support units of the present invention being worn by a user shown in the up position.
Figure 3:
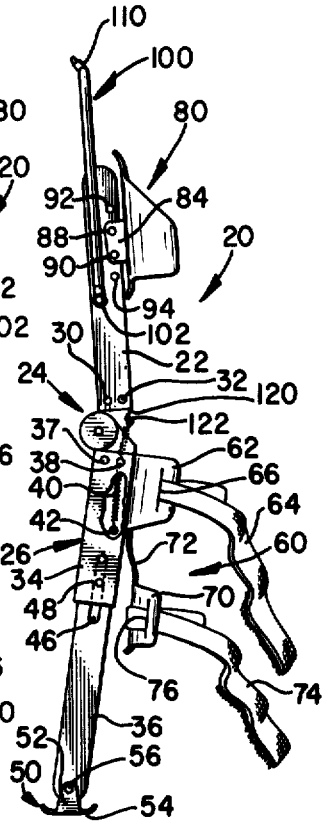
FIG. 3 illustrates a side view of one of the support units of the present invention in the up position.

FIGS. 1 and 2 illustrate the support unit 20 attached to the legs of a user. In FIG. 1, support units 20 are shown in the seated or down position while FIG. 2 is a rear view of the support units 20 in their up position. FIG. 3 illustrates a side view of one of the support units 20 in the up position.

Support units 20 are identical one to the other and are used in pairs, one being attached to each leg of the user. Because the units are identical, the following description will be directed to a single unit with the understanding that in the primary embodiment one unit is attached to each leg of the user.

Referring now to FIGS. 1, 2 and 3, support unit 20 includes an upper bar 22 connected by a hinge 24 to a lower bar 26. Although any material or configuration may be used, in the preferred embodiment of the present invention, upper bar 22 is a square aluminum tube extrusion connected to hinge 24 by bolts 30 and 32. Lower bar 26 includes an upper tube 34 and a lower tube 36 which is slidably received into upper tube 34. In the preferred embodiment, upper tube 34 is a square aluminum tube extrusion joined to hinge 24 by appropriate bolts 37 and 38. Lower tube 36 is similarly a square aluminum extrusion having an outside dimension slightly smaller than the inside dimension of upper tube 34 and a tetra-fluro-ethylene polymer commonly available under the trademark TEFLON so that lower section 36 may be slidably received into upper tube 34. A spring 40 is attached between upper tube 34 at bolt 38 and to lower tube 36 at pin 42 and normally urges lower tube 36 upwardly into upper tube 34.

Lower tube 36 has a slot 46 in each side thereof and a pin 48, attached to upper tube 34, extends from one side of tube 34 to the other and through both slots in lower tube 36. Lower tube 36 may then be selectively telescoped from and retracted within upper tube 34 with the travel of lower tube 36 being limited by the engagement of pin 48 by the upper and lower ends of slots 46. Apertures 36*a* are drilled in the back side of lower tube 36. Upper tube 34 is cut away to reveal apertures 36*a* as is shown in FIG. 2. The lower end of lower tube 36 is fitted with a foot 50. Foot 50 includes two upwardly extending parallel arms 52 connected at their lower end by a curved foot pad 54. A pin 56 is fitted through apertures in arms 52 and through the lower end of lower tube 36 and pivotally engages foot 50 to lower tube 36.

A calf support 60 is attached to upper tube 34 of lower bar 26 by suitable means such as riveting or screws (not shown). Calf support 60 includes an upper flexible U-shaped support 62 for receiving the calf area of the lower leg of the user and supports a strap 64 through slots 66 in support 62. Strap 64 may be fitted with velcro for engaging support 62 around the calf of the leg of the user. A second flexible U-shaped support 70 is attached below support 62 by a flexible connector 72 and also receives a strap 74 through slot 76 therein. Strap 74 may also be made from velcro and is used for engagement of support 70 immediately below the calf of the lower leg of the user.

An upper thigh support 80 is attached near the upper end of upper bar 22. Thigh support 80 includes a flexible U-shaped cup 82 with a channel fitting 84 attached thereto by suitable means such as riveting or screws (not shown). Channel fitting 84 is sized to over engage tubular upper bar 22 and is attached thereto by bolts 88 and 90 through the legs of fitting 84. Additional apertures 92 and 94 are provided in upper bar 22 such that thigh support 80 may be adjusted upwardly or downwardly according to the height of the user.

A brace 100 is attached to upper bar 22 at axis shaft 102. Brace 100 includes side legs 104 and 106 joined by a base leg 108. A nipple 110 is attached to the midpoint of base leg 108. Brace 100 is sized so that nipple 110 may be engaged in apertures 36*a* of section 36 as will be hereinafter discussed in greater detail.

Figure 4:
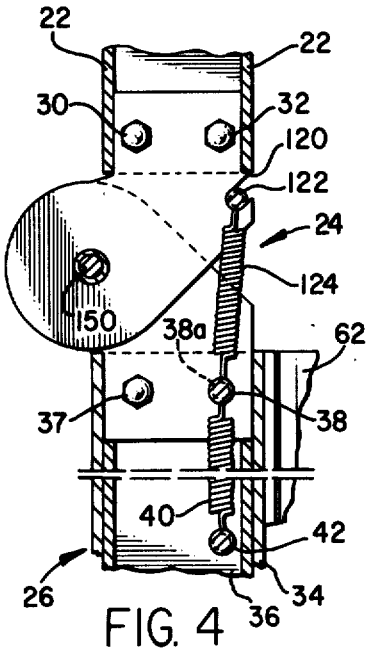
FIG. 4 is an enlarged side elevation partially broken away of the hinge of the present invention.

As is shown in FIGS. 3 and 4, a notch 120 is formed in hinge 24 and receives a pin 122 therein. Springs 124 are attached between pin 122 and bolt 38 in lower bar 26. These springs are positioned on the wearer side of the pivot point of hinge 24 and thus act to rotate upper bar 22 in a clockwise direction relative to lower bar 26 (as viewed from FIG. 3) to urge thigh support 80 against the back part of the upper leg of the user.

Figure 5:
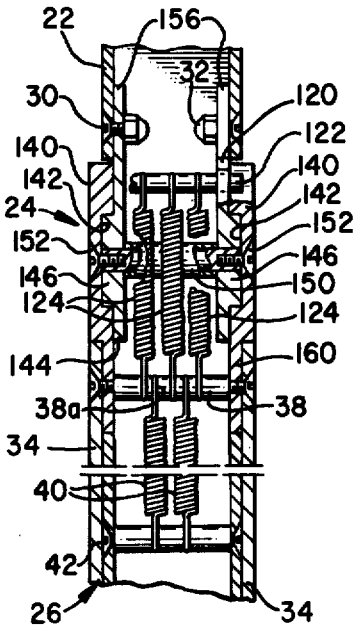
FIG. 5 is a vertical section view of the hinge of the present invention shown in FIG. 4.

Referring to FIG. 5, hinge 24 has outer plates 140 each formed with a circular recess 142 therein. Inner plates 144 are each formed with a corresponding circular hub 146 which engage circular recess 142. The surfaces of contact between these two members are tetra-fluro-ethylene polymer commonly available under the trademark TEFLON or supplied with other lubrication in order to permit free relative movement therebetween. The hinge also includes a circular spacer 148 and pin 150. Screws 152 engage through outer and inner plates 140 and 144 and into pin 150 to complete the hinge. Outer plates 140 are formed with legs 160 which are attached to lower bar 26 by bolts 37 and 38 (FIGS. 3 and 5) and inner plates 144 have upwardly extending legs 156 which are attached to upper bar 22 by bolts 30 and 32 (FIGS. 3 and 5).

FIG. 5 also shows the connection of springs 40 to bolt 38 as well as the connection of springs 124 to the bolt 38. Annular recesses 38*a* are formed about the circumference of bolt 38 in order to receive the ends of springs 40 and 124 and maintain their position along the bolt.

Figure 6:
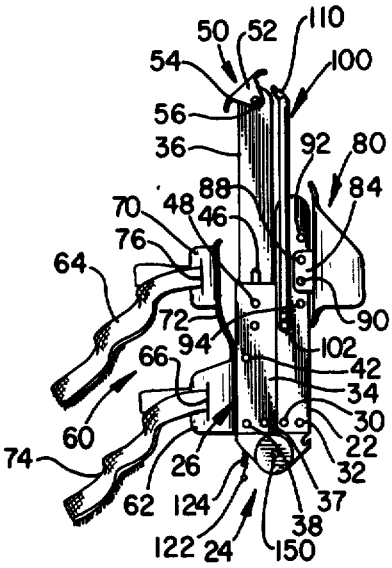
FIG. 6 illustrates a side view of a support unit of the present invention in a folded position.
Figure 7:
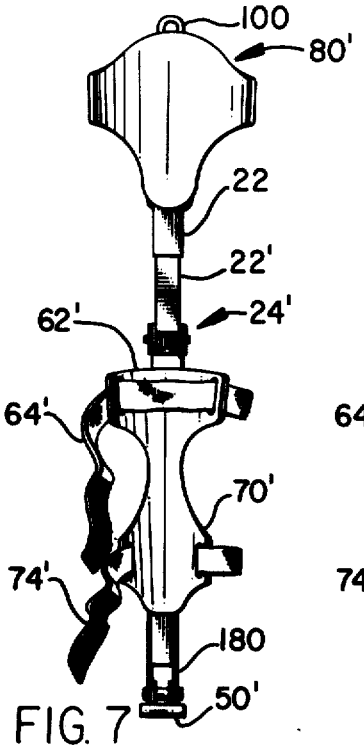
FIG. 7 is a front view of an alternative embodiment of the present invention of one of the support units of the present invention.
Figure 8:
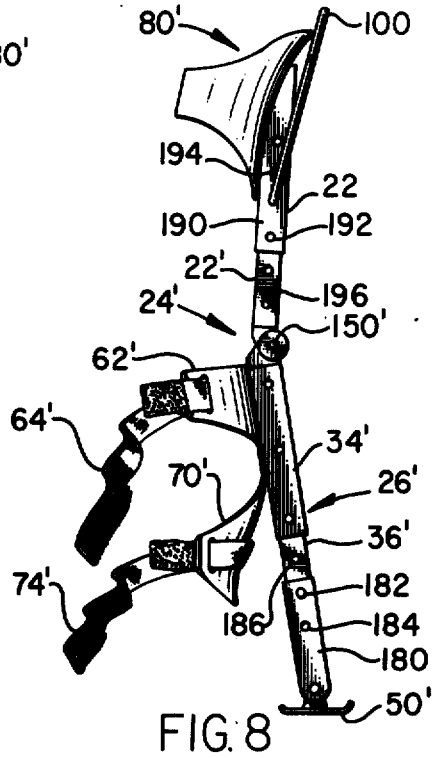
FIGS. 8 and 9 are left and right side views, respectively, of the embodiment illustrated in FIG. 7.

The pivot point of hinge 24 is defined by pin 150. Referring to FIGS. 4 and 6, it can be seen that pin 150, and thus the pivot point of hinge 24, is positioned substantially in line with the back surface of upper bar 22 and lower bar 26. Referring specifically to FIG. 6, this permits lower bar 26 to be folded against upper bar 22 in a compact package for storage or shipment. Likewise, brace 100 is positionable to the side of upper bar 22 and thus does not interfere with the folding of the lower bar immediately adjacent the upper bar.

Use of the support units to form a wearable support or chair is accomplished by attaching one unit to each leg by engaging straps 64 immediately above the calf of the leg and straps 74 at some point therebelow. When the unit is not being used as a support, lower tube 36 of lower bar 26 is automatically retracted upwardly away from the ground by tension spring 40 which normally urges lower tube 36 to its retracted position within upper tube 34. Upper bar 22 is urged against the portion of the upper leg of the user by the tension of springs 124. Thus, while the upper bar is not directly attached to the user's legs, the unit is maintained in contact with the upper part of the user's legs.

In using the unit as a body support or chair, brace 100 is pivoted downwardly about axis pin 102 and nipple 110 is engaged in one of the apertures 36*a* of lower tube 36. As the user crouches into a position, similar to that shown in FIG. 1, the thigh exerts pressure against thigh support 80 and rotates upper bar 22 downwardly toward lower bar 26. The engagement of nipple 110 of brace 100 into one of the apertures of lower tube 36 causes the extension of lower tube 36 from upper tube 34 of lower bar 22 until foot 50 engages the ground. In this position (FIG. 1) the upper thigh and seat area of the user is supported by the triangular structure formed by upper and lower bars 22 and 26, respectively, and brace 100 such that the weight of the body may be balanced on the units attached to the user's legs.

When the support is no longer needed, the user merely stands up. Lower tube 36 is automatically retracted into upper tube 34 of lower bar 26 by springs 40, and upper bar 22 is rotated to remain in contact with the back part of the leg of the user by the action of springs 124. Brace 100 is merely rotated by the user upwardly into the position illustrated in FIGS. 2 and 3. Brace 100 is maintained in this position by providing a force fit of the side members 104 and 106 against the side walls of upper bar 22. Alternatively, a retaining clip may be used to maintain brace 100 in the up position. Thus, the present invention provides wearable support units which are simple and lightweight and are at the user's disposal. The units are worn on the legs and form a triangular seating support as the user crouches into a seating position but retract upwardly out of the user's way upon rising.

FIGS. 7-11 illustrate an alternative embodiment of the present invention. Because many of the components of the embodiment illustrated in FIGS. 7-11 correspond to similar components in the embodiment illustrated and described with respect to FIGS. 1-6, these corresponding components are designated with the same numeral with a prime (') designation added.

The embodiment illustrated in FIGS. 7-11 likewise includes an upper bar 22' connected by a hinge 24' to a lower bar 26'. The lower bar 26' includes an upper tube 34' and a lower tube 36' slidably received therein. Lower tube 36' is fitted with a plurality of indentations 36a' (FIG. 10) which receive the upper end of brace 100' pivotally attached to upper bar 22'. Lower leg supports 62' and 70' are attached to upper tube 34' of lower bar 26'. Straps 64' and 74' are attached to supports 62' and 70', respectively, for attachment of the unit to the leg of the user. A thigh support 80' is attached to upper bar 22' for engagement with the back portion of the upper leg of the user.

The embodiment illustrated in FIGS. 7-11 differs from the embodiment illustrated in FIGS. 1-6 by the addition of a lower extension 180 attached between lower tube 36' and foot 50'. Lower extension 180 is selectively attached to lower tube 36' by bolts 182 and 184. Lower tube 36' is fitted with a plurality of apertures 186 for receiving bolts 182 and 184 such that the lower bar 26' may be lengthened or shortened to accommodate the height of the user.

Similarly, upper bar 22' differs from upper bar 22 of the embodiment illustrated in FIGS. 1-6 by the addition of an extension 190 positioned over upper bar 22' and attached thereto by bolts 192 and 194. Upper bar 22' includes a plurality of apertures 196 for receiving bolts 192 and 194 and permitting the extension or retraction of extension 190 relative to upper bar 22' to lengthen or shorten the effective length of bar 22' to accommodate the height of the particular user.

Figure 10:
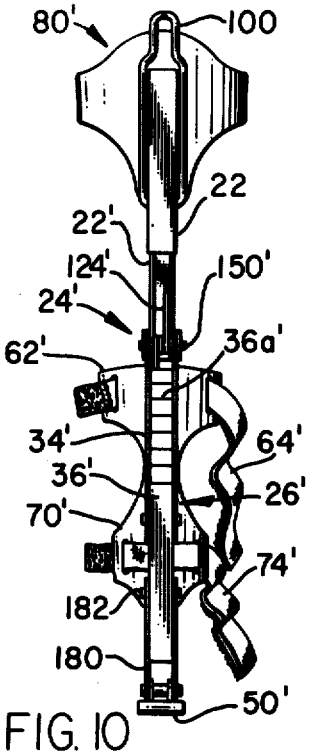
FIG. 10 is a rear view of the embodiment illustrated in FIG. 7.
Figure 9:
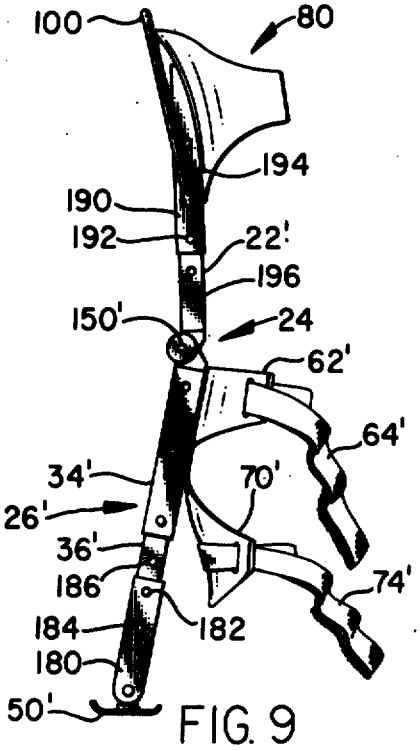
Figure 11:
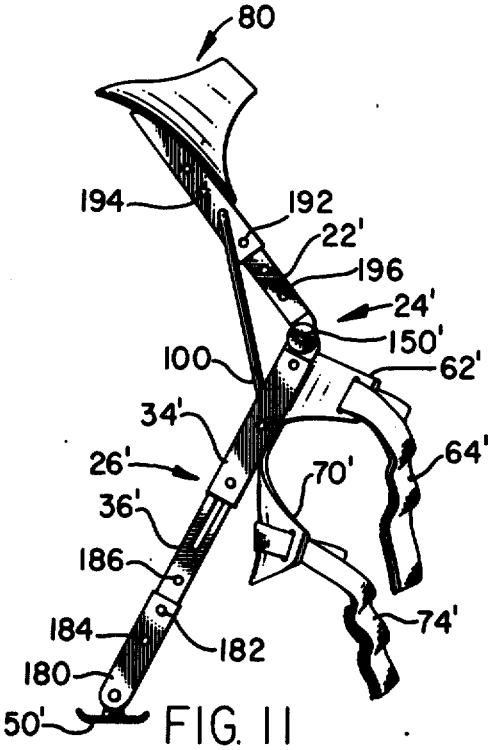
FIG. 11 is a side view of the embodiment illustrated in FIG. 7 with the support unit in the seated position.

The embodiment of FIGS. 7-11 also illustrates that alternatives to springs 124 of the embodiment illustrated in FIGS. 1-6 may be incorporated into the present invention. Referring to FIG. 10, a loop spring 124' encircles pin 150' and urges upper bar 22' in a clockwise direction as viewed in FIG. 9 relative to lower bar 26'. As discussed hereinabove, in this way thigh support 80' is urged against the back part of the upper leg of the user at all times.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements as fall within the scope of the appended claims.

What is claimed is:

1. An apparatus for supporting the weight of an individual's body from a ground surface including a unit for attachment to each leg of the individual, each unit comprising:

a lower bar having a top section and a bottom section slidable relative to the top section;

means for attaching the top section of said lower bar to the leg of the individual;

an upper bar;

means for hingeably connecting said upper bar from the top section of said lower bar; and a brace member selectively positionable between said upper bar and the bottom section of said lower bar to telescope the bottom section from the top section of said lower bar as said upper bar is rotated toward said lower bar for engagement of the lower section of said lower bar with the ground surface from which the weight of the individual's body may be supported.

2. The apparatus according to claim 1 further comprising:

hinge means for hingeably attaching said brace member to said upper bar; and structure forming apertures in the lower section of said lower bar for receiving the end of said brace member opposite said hinge means for engagement into said lower bar.

3. The apparatus according to claim 1 wherein said means for attaching said lower bar to the leg of the individual is characterized by at least one first strap attached to the upper section of said lower bar for engagement around the leg of the individual.

4. The apparatus according to claim 3 further comprising:

a second strap attached to the lower section of said lower bar at a point removed from said first strap, said second strap adapted for engagement around the leg of the individual.

5. The apparatus according to claim 1 wherein said means for attaching the lower section of said lower bar to the leg of the individual includes a flexible cup-like structure with straps attached thereto for engagement around the lower leg of the individual, and further comprises a second cup-like support attached to said upper bar adjacent the upper part of the leg of the individual.

6. The apparatus according to claim 1 further comprising:

spring means for normally urging said bottom section of said lower bar longitudinally toward said top section.

7. The apparatus according to claim 1 further comprising spring means for normally urging said upper bar to pivot about said hinge means toward the leg of the individual.

8. The apparatus according to claim 1 wherein said means for hingeably connecting said upper bar from said lower bar is characterized by a hinge attached between said upper bar and said lower bar with the pivot point substantially at the section of the sides of said upper and lower bars opposite said means for attaching the lower bar to the leg of the individual where the apparatus may be folded about the pivot point such that the lower bar is adjacent the upper bar.

9. The apparatus according to claim 1 further comprising:

a foot member pivotally attached to the end of said lower bar remote from the point of hingeable connection to said upper bar.

10. The apparatus according to claim 1 further comprising means for adjusting the length of said lower bar to compensate for the height of the individual.

11. The apparatus according to claim 1 further comprising:

means for adjusting the length of said upper bar to compensate for the height of the individual.

12. A wearable chair including a unit for attachment to each leg of the wearer, each unit comprising:

a lower bar having a top section and a bottom section slidable relative to the top section;

means for attaching the top section of said lower bar to the leg of the wearer;

an upper bar;

means for hinging said upper bar from the top section of said lower bar; and brace means for engagement between said upper bar and the bottom section of said lower bar to telescope the bottom section of said lower bar from the top section thereof until engagement with the ground surface by rotating said upper bar toward said lower bar thereby providing the upper bar as a support for the wearer.

13. The apparatus according to claim 12 further comprising:

hinge means for hingeably attaching said brace member to said upper bar; and structure forming apertures in said lower bar for receiving the end of said brace member opposite said hinge means for engagement into said lower bar.

14. The apparatus according to claim 12 wherein said means for attaching said lower bar to the leg of the wearer is characterized by at least one first strap attached to the lower section of said lower bar for engagement around the leg of the wearer.

15. The apparatus according to claim 14 further comprising:

a second strap attached to the lower section of said lower bar at a point removed from said first strap, said second strap adapted for engagement around the leg of the wearer.

16. The apparatus according to claim 13 wherein said means for attaching the lower bar to the leg of the wearer includes a flexible cup-like structure with straps attached thereto for engagement around the lower leg of the wearer; and further comprising a second cup-like support attached to said upper bar adjacent the upper part of the leg of the wearer.

17. The apparatus according to claim 13 further comprising:

spring means for normally urging said bottom section of said lower bar longitudinally toward said top section.

18. The apparatus according to claim 13 further comprising spring means for normally urging said upper bar to pivot about said hinge means toward the leg of the wearer.

19. The apparatus according to claim 13 wherein said means for hingeably connecting said upper bar from said lower bar is characterized by a hinge attached between said upper bar and said lower bar with the pivot point substantially at the intersection of the sides of said upper and lower bars opposite said means for attaching the lower bar to the leg of the wearer where the unit may be folded about the pivot point such that the lower bar is adjacent the upper bar.

20. The apparatus according to claim 13 further comprising:

a foot member pivotally attached to the end of said lower bar remote from the point of hingeable connection to said upper bar.

21. The apparatus according to claim 13 further comprising means for adjusting the length of said lower bar to compensate for the height of the wearer.

22. The apparatus according to claim 13 further comprising:

means for adjusting the length of said upper bar to compensate for the height of the wearer.

* * * * *